US012650021B2

(12) United States Patent
Simões Vicente

(10) Patent No.: US 12,650,021 B2
(45) Date of Patent: Jun. 9, 2026

(54) SYSTEM AND METHOD FOR FITTING FLOOR MODULES

(71) Applicant: ISSG SPORTS INNOVATIONS, LDA, Charneca de Caparica (PT)

(72) Inventor: Nuno Miguel Simões Vicente, Charneca de Caparica (PT)

(73) Assignee: ISSG SPORTS INNOVATIONS, LDA, Charneca de Caparica (PT)

( * ) Notice: Subject to any disclaimer, the term of this patent is extended or adjusted under 35 U.S.C. 154(b) by 260 days.

(21) Appl. No.: 18/697,198

(22) PCT Filed: Sep. 29, 2022

(86) PCT No.: PCT/IB2022/059274

§ 371 (c)(1),
(2) Date: Mar. 29, 2024

(87) PCT Pub. No.: WO2023/053050

PCT Pub. Date: Apr. 6, 2023

(65) Prior Publication Data

US 2024/0376721 A1 Nov. 14, 2024

(30) Foreign Application Priority Data

Sep. 29, 2021 (PT) ..... 117489

(51) Int. Cl.
*E04F 15/02* (2006.01)

(52) U.S. Cl.
CPC ..... *E04F 15/02* (2013.01); *E04F 2201/0552* (2013.01)

(58) Field of Classification Search
CPC ..... E04F 15/02; E04F 2201/0552; E04F 2201/0153; E04F 2201/021; E04F 2201/049; E04F 15/02038
See application file for complete search history.

(56) References Cited

U.S. PATENT DOCUMENTS

| | | | | | |
|---|---|---|---|---|---|
| 3,846,945 | A * | 11/1974 | Roby | E04F 15/02172 | 52/592.1 |
| 3,909,996 | A * | 10/1975 | Ettlinger, Jr. | E04F 15/02172 | 52/177 |
| 8,973,328 | B2 * | 3/2015 | Masanek, Jr. | E04F 15/02022 | 52/592.1 |
| 9,816,280 | B1 * | 11/2017 | Reitnauer | E04F 15/02038 | |
| 2017/0226752 | A1 * | 8/2017 | Tsai | E04F 15/02194 | |

FOREIGN PATENT DOCUMENTS

| | | | | |
|---|---|---|---|---|
| CA | 2353431 | A1 * | 1/2002 | |
| GB | 2517450 | A * | 2/2015 | E04F 15/02005 |
| WO | WO-2016001886 | A1 * | 1/2016 | E04F 15/043 |

* cited by examiner

*Primary Examiner* — Adriana Figueroa

(57) ABSTRACT

The present invention relates to a fitting system to be used to connect floor modules, such as the fitting method and disengaging method. The system comprises two elements, a female element and a male element, connected to floor modules and interconnecting to each other. The female element comprises a body of the female, at least one ramp and at least one tongue, resting on the plate of the female. The male element comprises a body of the male and a fitting element comprising a plate of the male, sidewalls, a rim, at least one groove delimited by groove walls, and at least one slider. The system features double locking, which prevents the elements from making movements in any vertical or horizontal direction.

15 Claims, 6 Drawing Sheets

SYSTEM AND METHOD FOR FITTING FLOOR MODULES

This application is a National Stage of International Application No. PCT/IB2022/059274, filed 29 Sep. 2022, which claims priority to and the benefit of Portuguese Patent Application No. 117489, filed 29 Sep. 2021, the entireties of which are hereby incorporated herein by reference.

SCOPE OF THE INVENTION

The present invention generically relates to the use of modular floors, indoors or outdoors, more specifically to a system and method for fitting floor modules by means of a male element and a female element that are not part of the modules but are attached to them.

FRAMEWORK OF THE INVENTION

In multipurpose pavilions it is common to use floors, usually in wood, laid over the original floor of the building, commonly made of cement. Normally, such floors need to be installed on top of the original floor, which involves assembling it, because for storage reasons it is divided into modules, which are transported to the pavilions. Likewise, when the event is over, these modules are disassembled so that they can be transported back to the storage location. There may also be no assembly and disassembly of the floor, if it is to be permanently installed in the pavilion.

The process of assembling and disassembling floors is time-consuming. It can take from 8 to 16 hours, depending on the number of floor modules to be laid. Often, whenever it is necessary to change floors between events, the same hall cannot have more than one event taking place on the same day due to logistical impediments caused by the assembly and disassembly of floors. Such an impediment can cause financial losses because opportunities to hold more events are lost. Even in cases where a pavilion can host two events on the same day, they have to be held at times far enough apart to leave time for the floor to be assembled and disassembled.

The floor assembly process comprises the successive repetition of several steps. First, the flooring module is placed on the floor. Next, it is aligned with the floor module or modules that it will fit into, and then, if necessary, its position is modified for better alignment, and then it is fitted, and there may be a final step of adjustment of the fittings, if, for example, there are gaps, which usually occur due to prolonged and repetitive use. These numerous steps end up making the floor assembly process longer.

Therefore, the need was identified to produce a fitting that would allow as few steps as possible to be performed, to save time in assembling floors. Additionally, by not using the wood of the flooring modules itself to make the joints, the wood is saved from damage, leading to more durable flooring modules, without requiring their frequent replacement, which becomes an economic advantage.

BACKGROUND OF THE INVENTION

The state of the art includes some documentation that presents inventions linked to floor module fittings, to be used in floor assembly.

Document WO0198604 presents a male-female fitting system for use in flooring modules, which contains a male part and a female part. Both pieces feature a tongue, which is attached to a groove formed in the wood using glue. The male fitting element is a "V" shaped leg that acts as a spring and the female fitting element is dimple shaped to complement the male fitting element. When aligning both parts, the male fitting element is directly above the female fitting element, and force is then applied in a downward direction so that the male fitting element contracts and enters the female fitting element. When the point of greatest friction is passed, the male fitting element expands, fitting into the female element. This invention requires at least two assembly steps: the alignment step and the fitting step. It also has the disadvantage of having to manipulate the shape of the wood.

Document EP2010733 presents an invention similar to the previous document, with the method of fitting being a knob on the male part and a notch in the female part. The process of assembling the floor module requires at least one more step than the invention described in the previous document, which is the alignment adjustment. It is also necessary to make deformations in the floor module, so that the fitting system can be attached to it.

Document EP3330454 presents a system for lateral fitting of floor modules, which comprises a male element with a plate for attachment to the floor module and another plate for attachment to the female element, and a female element with a plate for fitting to the floor module and another plate where the male element fits. The female snap plate has a rail, through which the male snap plate slides. This system requires no changes to the shape of the wood, however it does require at least three fitting steps: alignment, alignment adjustment, and fitting. Also, the fit between the male element socket plate and the snap plate of the female element is tight, which allows gaps to form through continued use of the invention described in the document, and may lead to a fourth step in the assembly of the floor modules: the adjustment of the fit.

Document FR2917761 shows a floor module with an embedded fitting system. The floor module has a substantially square shape, in which one longitudinal side and one lateral side have male grooves, and the other longitudinal side and the other lateral side have female grooves, and the female grooves fit between the male grooves. These fittings are made up of boards that are placed at the ends of the underside of the floor modules. This invention does not require manipulation in the shape of the floor module, but it also requires at least three steps to be carried out. Also, the fit between the male fittings and the female fittings is tight, which can cause looseness in the fittings, possibly requiring an additional adjustment step with continued use of the system.

Advantages of the Invention

The documents referred to in the state of the art allow flooring modules to be fitted to one another. However, these modules require at least two steps to do the fitting, namely the alignment phase and the fitting itself. In other cases, although the assembly is done with only the alignment step, the fitting depends on the wood directly, in which grooves are made, so repeated fitting will eventually cause gaps to emerge in the wood, which will eventually damage the flooring module, requiring its replacement. Additionally, due to the intense use of the floor, the fittings cannot withstand impacts caused by sudden movements of the users, and the wood ends up having to bear this excess energy, which can cause it to break.

The present invention overcomes the problems present in the state of the art solutions by allowing the flooring modules to be fitted in a single step, the alignment step, without having to make changes to the wood or using the wood directly to do the fitting.

Additionally, in closed formation, when the two floor modules are attached together, they are double locked: the floor modules remain locked together in horizontal and vertical movements. The slide fit allows for easy assembly and a longer lifespan by removing the possibility of gaps appearing in the different parts of the system. The aforementioned feature also gives the system greater flexibility by allowing greater dissipation of the energy of the impacts on the floor module.

BRIEF DESCRIPTION OF THE DRAWINGS

These and other features can be easily understood in the attached drawings, which should be considered mere examples and in no way restrict the scope of the invention. In the drawings, and for illustrative purposes, the measurements of some of the constituent parts may be exaggerated and not drawn to scale. The absolute dimensions and the relative dimensions do not correspond to the actual ratios for the invention.

In an example of a preferred embodiment:

FIG. 11*a* shows an overview of the fitting performed between the male element and the female element, showing the interaction between the ramp with the slider and the tongue with the groove. FIG. 11*b* highlights the interaction between the ramp of the female element and the slider of the male element. FIG. 11*c* highlights the interaction between the tongue of the female element and the groove of the male element.

The elements and components of the equipment of this invention and the elements needed to operate the present invention are marked in the figures:

1. female element
- 1.1. body of the female
  - 1.1.1. sidewall of the female
  - 1.1.2. end wall
  - 1.1.3. opening of the female
- 1.2. plate of the female
- 1.3. ramp
- 1.4. tongue

2. male element
- 2.1. body of the male
  - 2.1.1. opening of the male
  - 2.1.2. overhang
- 2.2. fitting element
  - 2.2.1. plate of the male
  - 2.2.2. sidewall of the male
  - 2.2.3. slider
  - 2.2.4. groove
  - 2.2.5. rim
  - 2.2.6. groove wall

3. protrusion

DETAILED DESCRIPTION OF THE INVENTION

The terms "substantially horizontal", "substantially vertical", "substantially coplanar", "substantially aligned", "substantially centred", "substantially parallel", "at a distance from" and "substantially perpendicular" are describers of various possible positions for the components of the invention, and the components may function in other positions.

The terms "substantially rectangular trapezoidal", "U-shape", "closed U-shape", "substantially parallelepiped", "substantially complementary", "mutually complementary", "rectilinear", "substantially rectilinear", "curvilinear", "concave", "convex", "indented", "bevel" and "prismatic hexagonal concave" mean various possible shapes or forms or possible formats for the components of the invention, and the components may function with other forms or formats.

The term "wall" means a three-dimensional component of the equipment of the invention. Unless explicitly otherwise stated for a particular wall, all the walls have a substantially parallelepiped format.

Figure 1:
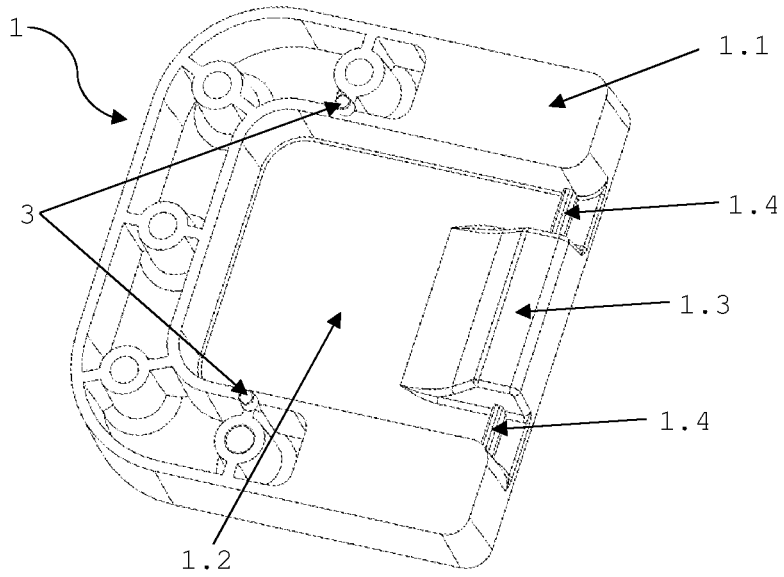
FIG. 1 shows an overhead perspective of the female element of the system of the invention.
Figure 2:
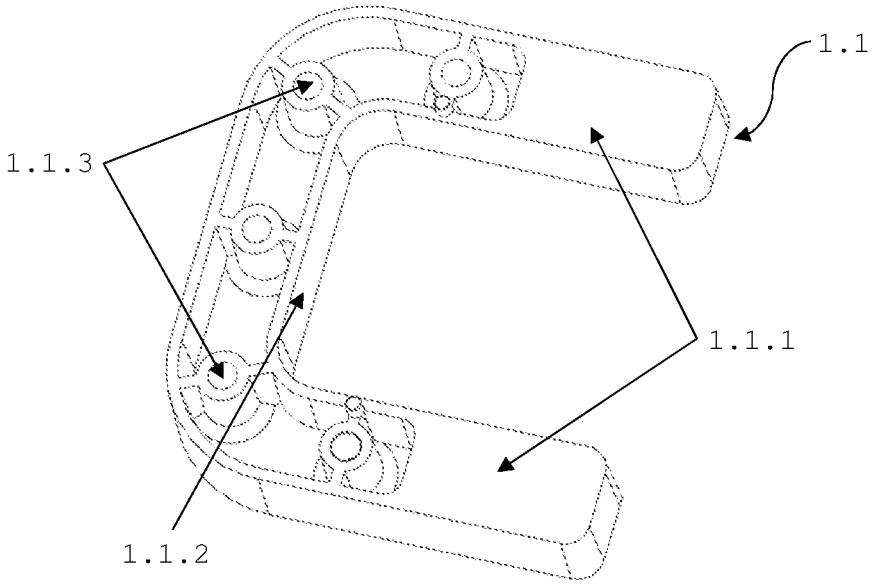
FIG. 2 shows an overhead perspective of the body of the female element of the system of the invention.
Figure 3:
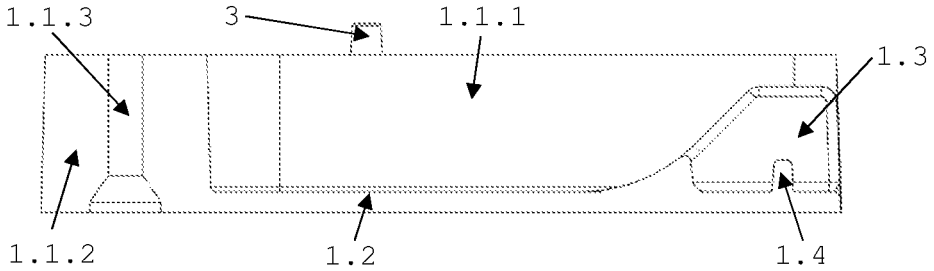
FIG. 3 shows a cross-section view of the female element of the system of the invention.
Figure 4:
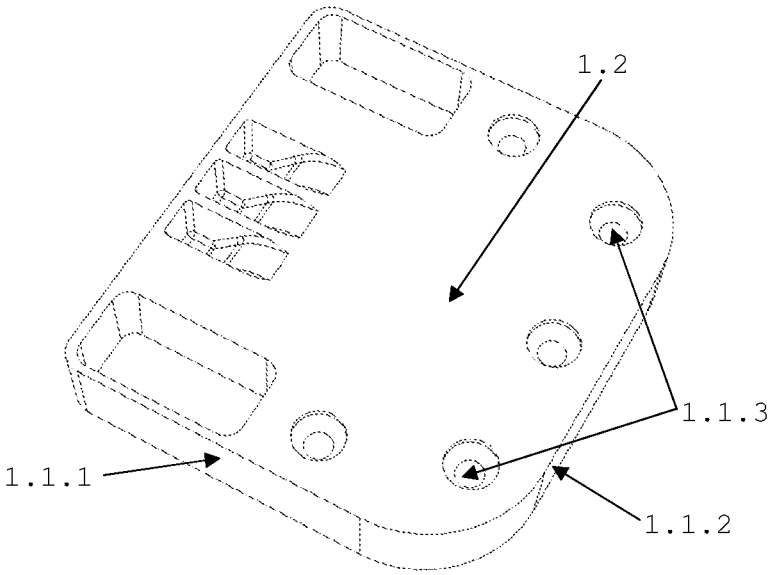
FIG. 4 shows an underneath view of the female element of the invention system.
Figure 5:
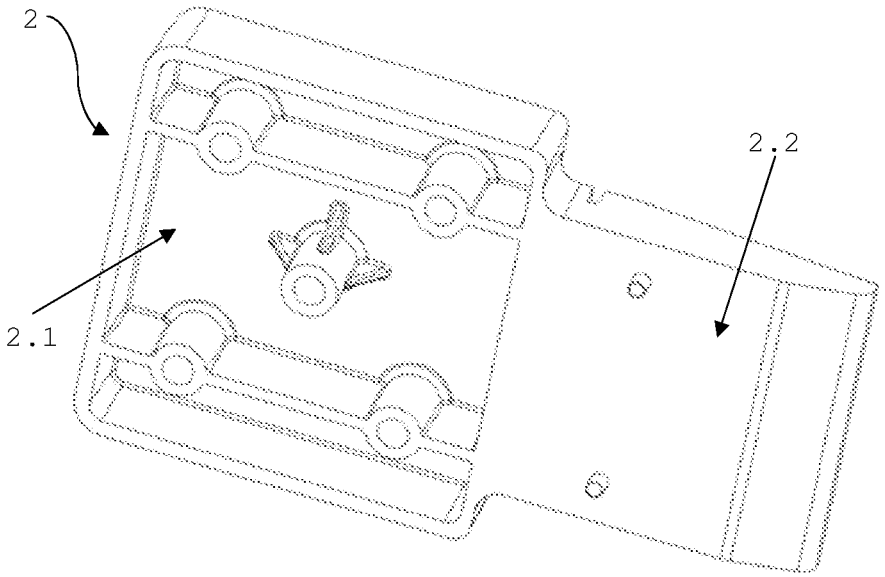
FIG. 5 shows an overhead view of the male element of the system of the invention, where the body of the male and the fitting element are observable.
Figure 6:
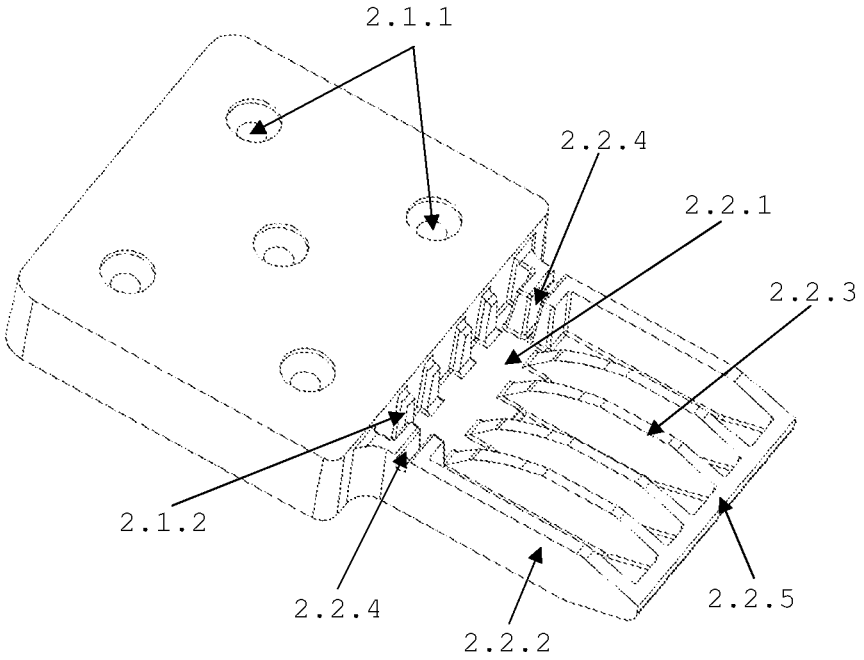
FIG. 6 shows an underneath view of the male element of the system of the invention.
Figure 8:
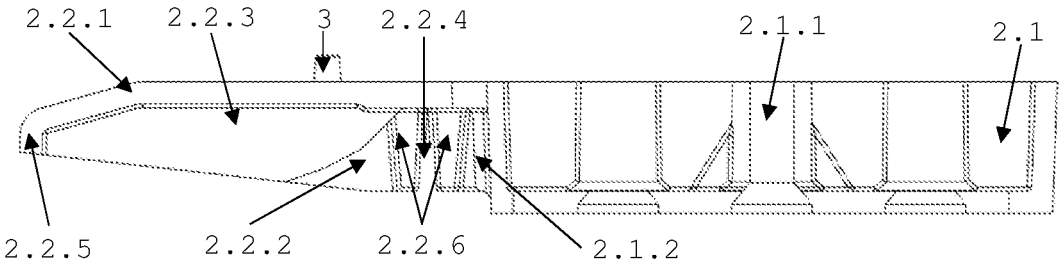
FIG. 8 shows a cross-section view of the male element of the system of the invention.
Figure 9:
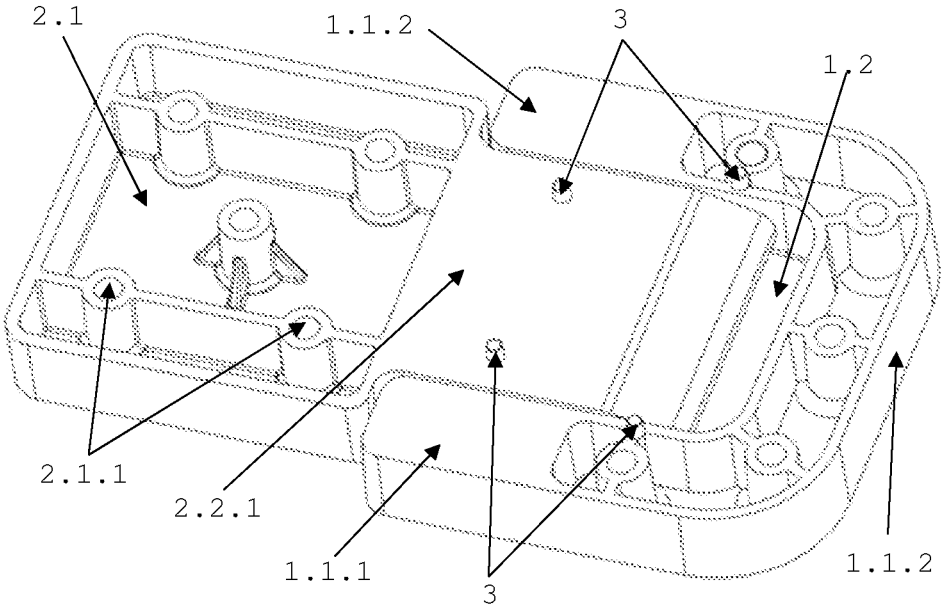
FIG. 9 shows an overhead view of the system of the invention in the closed formation.
Figure 10:
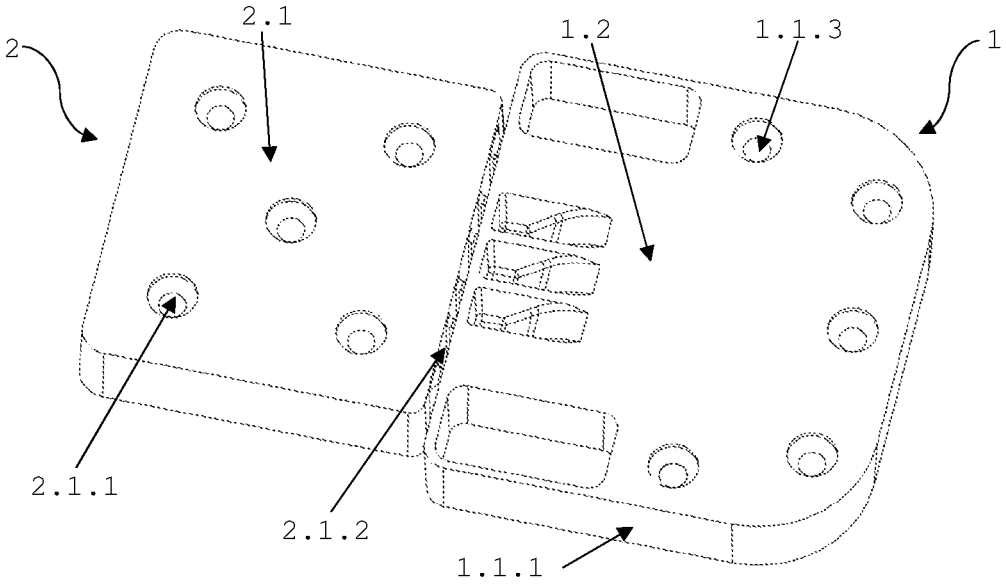
FIG. 10 shows an underneath view of the system of the invention in the closed formation.
Figure 11A:
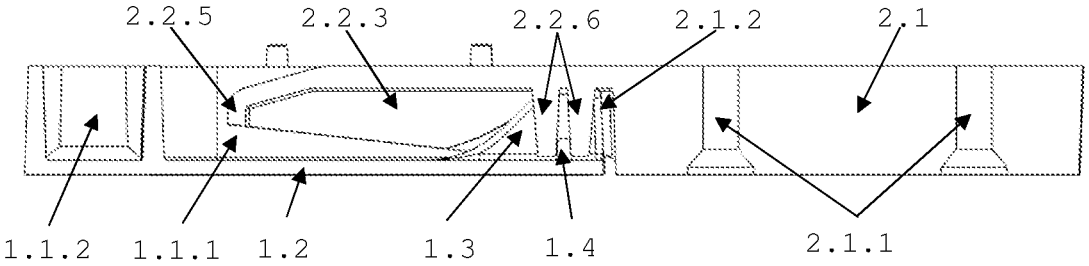
FIGS. 11*a*, 11*b* and 11*c* show cross-section views of the system of the invention in the closed formation.
Figure 11B:
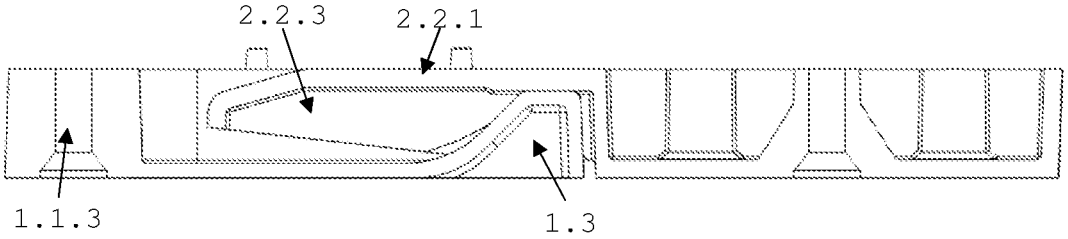
Figure 11C:
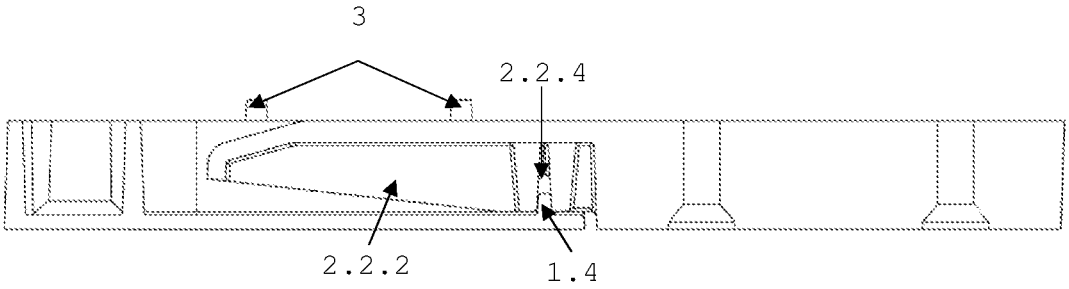

FIGS. 3, 8 and 11*b* show, respectively, a cross-section view of the female element (1), the male element (2) and the equipment of the invention in closed formation, with the cross-section made along the longitudinal plane through the centre of the elements of the invention. "Longitudinal" means coplanar or parallel planes to the longitudinal plane through the centre of the elements of the invention, such as components that lie in these planes. Likewise, "longitudinal movement" means the parallel movement of an element of the invention in relation to a longitudinal plane.

The terms "length" and "width" mean the dimensions measured in a horizontal plane, whereby the length is the longitudinal dimension and the width is the dimension perpendicular to the longitudinal dimension.

The terms: "lateral side", "underside", "upper side", "top", "inner", "outer", "adjacent", "joined", "inner side", "outer side", "sloping side", "sidewall", "end wall", "top wall", "at a reflex angle", "inner portion", "outer portion", "substantially equal", "lower height", and "front end" used in the description are for descriptive purposes and not necessarily to describe the relative positions. It should be noted that the terms above are used interchangeably in appropriate circumstances and that the embodiments of the invention described herein are capable of operating in orientations other than those described or illustrated herein.

The application of the principles described herein are not limited to the embodiments presented.

The principles described herein can be applied to any fitting system.

Additionally, although some embodiments present multiple new features, all features can be independent and it is not essential to use them all in one single embodiment.

The fitting systems according to the principles described herein can comprise any number of the features shown.

With reference to the figures, the present invention refers-to a fitting system for use in flooring modules. The system comprises two elements, a female element (1) and a male element (2), connected to the floor modules, and which interlock with each other.

The female element (1) and the male element (2) are attached to the same floor module on opposite sides, so that the male element (2) can fit into the female element (1) of the adjacent floor module, thus allowing the interconnection of the floor modules to cover the entire floor.

The female element (1) and the male element (2) are made of any suitable material, including but not limited to polyamide or any other polymer-based material. These materials are characterized by their high resistance to stress, which is essential for the proper functioning of the system, ensuring its durability.

Female Element

According to FIGS. 1, 2, 3 and 4 the female element (1) comprises a body of the female (1.1), a plate of the female (1.2), at least one ramp (1.3), at least one tongue (1.4) and a cavity.

The body of the female (1.1) has a "U" shape, comprising two sidewalls of the female (1.1.1), substantially parallel to each other, and an end wall (1.1.2). In a preferred embodiment, the interior of the body of the female (1.1) is hollow, while in a second embodiment it is filled. In a preferred embodiment, the body of the female (1.1) has no top wall.

It is on the plate of the female (1.2) that the body of the female (1.1) lies. In a preferred embodiment, the plate of the female (1.2) has a closed "U" shape. In a preferred embodiment, the plate of the female (1.2) has the same horizontal dimensions as the body of the female (1.1), with the outer contours of the body of the female (1.1) substantially overlapping the outer contours of the plate of the female (1.2). In this embodiment, one of the lateral sides of the plate of the female (1.2) is partially overlapped by the outer contours of the body of the female (1.1), which is the outer side of the plate of the female (1.2).

In the space delimited by the body of the female (1.1), and below by the plate of the female (1.2), one finds the cavity.

The body of the female (1.1) additionally has at least two openings of the female (1.1.3), preferably five. The openings of the female (1.1.3) pierce the body of the female (1.1) and the plate of the female (1.2) and allow the passage of the fastening elements that attach the female element (1) to the floor module. Preferably, the fastening elements enter the openings of the female (1.1.3) through the plate of the female (1.2).

The female element (1) additionally comprises at least one ramp (1.3), preferably one, which is substantially rectangular trapezoidal in shape and which is included in the cavity, more specifically positioned between the sidewalls of the female (1.1.1) and lying on the plate of the female (1.2). In a preferred embodiment, the interior of at least one ramp (1.3) is hollow.

At least one ramp (1.3) comprises:

an underside lying on the plate of the female (1.2);

a top:

in a position substantially parallel to the underside; and which is shorter than the length of the underside;

a sloping side, which:

is directed toward the inside of the female element (1); and has a concave or rectilinear format;

an outer side that is:

on the outer of the female element (1); and in a substantially vertical position and in a position substantially coplanar with the outer side of the plate of the female (1.2).

The sloping side of at least one ramp (1.3), in a preferred embodiment, has a mixed format; one part is substantially rectilinear and the other part is curvilinear. In a second embodiment, the sloping side of at least one ramp (1.3) has a curvilinear shape. In a third embodiment, the sloping side of at least one ramp (1.3) has a substantially rectilinear shape. In a preferred embodiment, the outer side of at least one ramp (1.3) is in a substantially coplanar position with the outer side of the plate of the female (1.2).

In a preferred embodiment, at least one ramp (1.3) has a height lower than the height of the body of the female (1.1). In a second embodiment, at least one ramp (1.3) has a height equal to the height of the body of the female (1.1).

The female element (1) additionally comprises at least one tongue (1.4), preferably two, which has a substantially parallelepiped shape, and preferably has a width greater than the length.

At least one tongue (1.4) is placed in the cavity. In a preferred embodiment, there are two tongues (1.4) that are located adjacent to each of the sidewalls of the female (1.1.1) and separated by a ramp (1.3) that is in a substantially centred position relative to the sidewalls of the female (1.1.1). In other embodiments, similar to the preferred embodiment, there is at least one tongue (1.4) between the two tongues (1.4) placed next to the sidewalls of the female (1.1.1), so there is a ramp (1.3) between every two consecutive tongues (1.4). In a second embodiment, there are two ramps (1.3) that are placed next to each sidewall of the female (1.1.1), and they are separated by a tongue (1.4) that is in a position substantially centred with respect to the sidewalls of the female (1.1.1) and which join the aforementioned two ramps (1.3). In other embodiments similar to the second embodiment, there is additionally at least one ramp (1.3) between the two ramps (1.3) placed next to the sidewalls of the female (1.1.1), so that there is a tongue (1.4) between every two consecutive ramps (1.3).

At least one tongue (1.4) is attached to the plate of the female (1.2) from the underside. In a preferred embodiment, at least one tongue (1.4) is indented with respect to the outer side of the plate of the female (1.2). In a preferred embodiment, the upper side of at least one tongue (1.4) has a convex shape. In a preferred embodiment, at least one tongue (1.4) has a height lower than the height of the ramp (1.3). In a second embodiment, at least one tongue (1.4) has a height equal to the height of the ramp (1.3).

When the female element (1) is attached to a floor module, the part of the plate of the female (1.2) on which at least one ramp (1.3) and at least one tongue (1.4) are assembled is outside the floor module. In a preferred embodiment, the body of the female (1.1) is partially placed under the floor module. In a second embodiment, the body of the female (1.1) is completely under the floor module.

In a preferred embodiment, the body of the female (1.1) has on the upper side at least one protrusion (3) that facilitates the fitting of the female element (1) into the floor module.

Male Element

According to FIGS. 5, 6, 7 and 8, the male element (2) comprises a body of the male (2.1) and a fitting element (2.2) attached to the body of the male (2.1).

In a preferred embodiment, the body of the male (2.1) has a substantially parallelepiped shape. The body of the male (2.1) is pierced by at least two openings of the male (2.1.1), preferably five, which allow the passage of fastening elements that attach the male element (2) to the floor module. Preferably, the fastening elements enter the openings of the male (2.1.1) from the underside of the body of the male (2.1). In a preferred embodiment, the interior of the body of the male (2.1) is empty, while in a second embodiment it is filled. In a preferred embodiment, the body of the male (2.1) has no top wall.

In a preferred embodiment, the body of the male (2.1) has a height substantially equal to the height of the body of the female (1.1).

Figure 7:
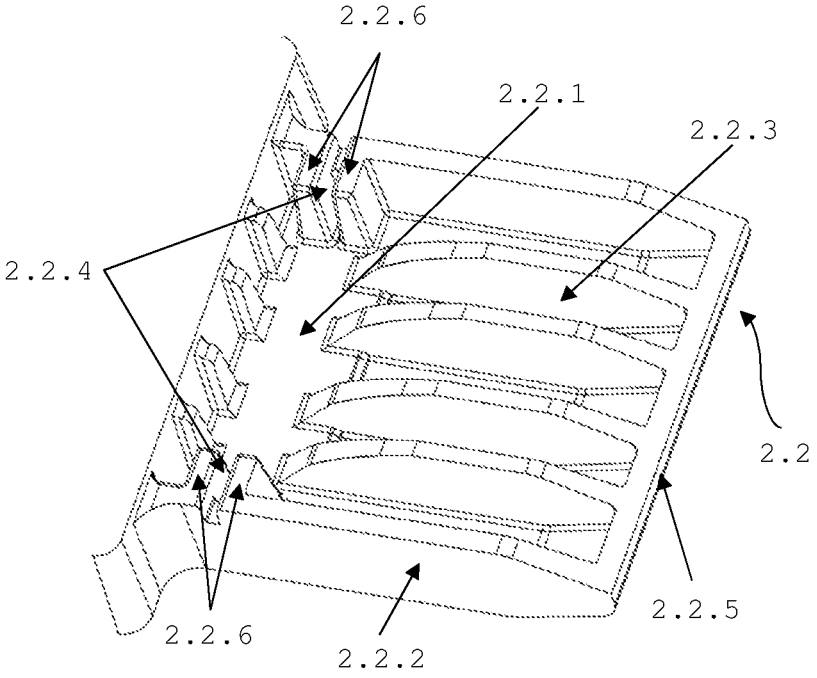
FIG. 7 shows an underneath view of the fitting element of the male element.

According to FIG. 7, the fitting element (2.2) comprises a plate of the male (2.2.1), sidewalls of the male (2.2.2), at least one slider (2.2.3), at least one groove (2.2.4), groove walls (2.2.6), and a rim (2.2.5).

In a preferred embodiment, the fitting element (2.2) has the correct width to fit into the female element (1), i.e. into the cavity, more specifically between the sidewalls of the female (1.1.1). This fit must be adjustable with extra space between the fitting element (2.2) and the sidewalls of the female (1.1.1), so that the fit provides a gap between the fitting element (2.2) and the sidewalls of the female (1.1.1), but without allowing the fitting element (2.2) to oscillate.

The plate of the male (2.2.1) is attached to the body of the male (2.1) through any of the lateral sides of the body of the male (2.1). In a preferred embodiment, the plate of the male (2.2.1) and the body of the male (2.1) have substantially coplanar upper sides.

In a preferred embodiment, the plate of the male (2.2.1) has a concave hexagonal prism shape, with an inner and an outer portion. The inner portion is substantially coplanar to the upper side of the body of the male (2.1). The outer portion makes a reflex angle in relation to the inner portion. In a second embodiment, the plate of the male (2.2.1) has a substantially parallelepiped shape.

The rim (2.2.5), with a substantially parallelepiped shape, is placed at the front end of the fitting element (2.2), specifically at the front end of the plate of the male (2.2.1). In a preferred embodiment, the vertical distance between the underside of the rim (2.2.5) and the upper side of the plate of the male (2.2.1) will not exceed the height of the body of the male (2.1).

In a preferred embodiment, the sidewalls of the male (2.2.2) have a bevel shape, with the front end bevelled. The sidewalls of the male (2.2.2) are in a substantially vertical and longitudinal position. In a preferred embodiment, the sidewalls of the male (2.2.2) have a lower height than the height of the body of the male (2.1). In a preferred embodiment, there are two sidewalls of the male (2.2.2) that are substantially parallel to each other.

The sidewalls of the male (2.2.2) are attached to the body of the male (2.1). The plate of the male (2.2.1) and the sidewalls of the male (2.2.2) are attached to the same side of the body of the male (2.1), which will hereafter be referred to as the body-fitting connection side.

In a preferred embodiment, the plate of the male (2.2.1) is attached to the upper sides of the sidewalls of the male (2.2.2). In a preferred embodiment, the rim (2.2.5) is attached to the front end of the sidewalls of the male (2.2.2).

At least one tongue (1.4) fits into at least one groove (2.2.4). At least one groove (2.2.4) is delimited by the groove walls (2.2.6). The groove walls (2.2.6) are in a substantially perpendicular position in relation to the sidewalls of the male (2.2.2). The groove walls (2.2.6) are attached to the plate of the male (2.2.1) on the upper side. In a preferred embodiment, the groove walls (2.2.6) are separated from the body of the male (2.1). In a second embodiment, one of the groove walls (2.2.6) is incorporated into the wall of the body of the male (2.1) that comprises the body-fitting connection side. In a preferred embodiment, the groove walls (2.2.6) are attached to the sidewalls of the male (2.2.2). In a second embodiment, the groove walls (2.2.6) are separated from the sidewalls of the male (2.2.2). In a third embodiment, the sidewalls of the male (2.2.2) incorporate at least one groove (2.2.4), with the groove walls (2.2.6) absent in this format. In a preferred embodiment, the groove walls (2.2.6) have a height substantially equal to the height of the sidewalls of the male (2.2.2).

In a preferred embodiment, at least one groove (2.2.4) is indented in relation to the body-fitting connection side. This indentation is substantially the same as the indentation between at least one tongue (1.4) and the outer side of the plate of the female (1.2).

At least one groove (2.2.4) has dimensions configured so that at least one tongue (1.4) fits with some extra space into at least one groove (2.2.4). That is, the fitting must ensure that a gap remains between at least one tongue (1.4) and the groove walls (2.2.6) that delimit at least one groove (2.2.4), but without the male element (2) oscillating.

In embodiments where there is more than one tongue (1.4) and there is more than one groove (2.2.4), there are preferably the same number of tongues (1.4) and grooves (2.2.4). Since the tongues (1.4) have to fit into the grooves (2.2.4), their shapes and positions have to be mutually complementary. The distance between two consecutive grooves (2.2.4) must be greater than the width of the ramp (1.3) adjacent to the tongues (1.4) that slot into the said grooves (2.2.4).

In a preferred embodiment, the fitting element (2.2) comprises at least one of the components selected from among the plate of the male (2.2.1) and the sidewalls of the male (2.2.2).

The fitting element (2.2) additionally comprises at least one slider (2.2.3), preferably four, which is substantially complementary in shape to the shape of at least one ramp (1.3) and which is positioned between the sidewalls of the male (2.2.2). In one embodiment, at least one slider (2.2.3) is attached to the sidewalls of the male (2.2.2).

At least one slider (2.2.3) slides on at least one ramp (1.3) during the fitting and disengaging process of the system, which allows the male element (2) to enter and exit the interior of the female element (1). As such, at least one slider (2.2.3) and at least one ramp (1.3) have a substantially complementary shape and position. At least one slider (2.2.3) comprises:

- an inner side:
  - directed towards the body of the male (2.1); and
  - which has a convex shape, substantially complementary to the sloping side of the ramp (1.3);
- an underside, which attaches the inner side to the rim (2.2.5) and which is substantially coplanar to the underside of the sidewalls of the male (2.2.2);
- an upper side attached to the plate of the male (2.2.1).

In a preferred embodiment, at least one slider (2.2.3) has a height substantially equal to the height of the sidewalls of the male (2.2.2). In a preferred embodiment, the inner side of at least one slider (2.2.3) has a mixed shape, with one part substantially rectilinear and the other part curvilinear. In a second embodiment, the inner side of at least one slider (2.2.3) has a curvilinear shape. In a third embodiment, the inner side of at least one slider (2.2.3) has a substantially rectilinear shape.

In the embodiments where there is more than one slider (2.2.3), these are substantially parallel to one another. Each slider (2.2.3) is separated from the adjacent slider (2.2.3) by any distance, provided that it allows each slider (2.2.3) to slide on at least one ramp (1.3).

In a preferred embodiment, the body of the male (2.1) additionally comprises at least one overhang (2.1.2), preferably four, which is attached to the body-fitting connection side. In a preferred embodiment, at least one overhang (2.1.2) has a substantially rectangular trapezoidal shape, where the sloping side is the underside and which is directed toward the inside of the fitting element (2.2).

In a preferred embodiment, the length of at least one overhang (2.1.2) is less than the distance between the body-fitting connection side and the groove wall (2.2.6) that is nearest to the body-fitting connection side.

In a preferred embodiment, the plate of the male (2.2.1) has on its upper side at least one protrusion (3) that facilitates the fitting of the male element (2) in the floor module.

Closed Formation

"Closed formation" describes the configuration of the equipment of the invention in which the male element (2) and the female element (1) are interconnected.

In the closed formation, the floor module where the female element (1) is attached is joined to the floor module where the male element (2) is attached.

According to FIGS. 9, 10, 11*a*, 11*b* and 11*c*, in the closed formation, the upper side of the body of the female (1.1) is substantially coplanar with the upper side of the body of the male (2.1). The same arrangement applies for the underside of both these components.

Figure 12:
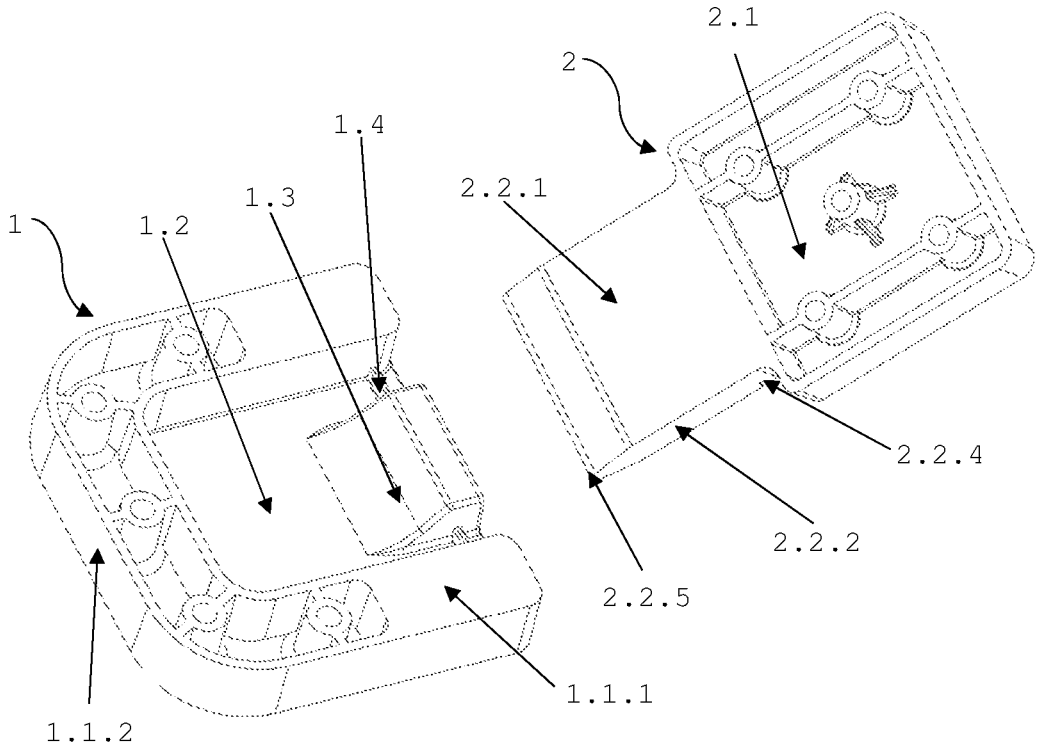
FIG. 12 shows an overhead view of the female element and the male element in the interlocked position.
Figure 13:
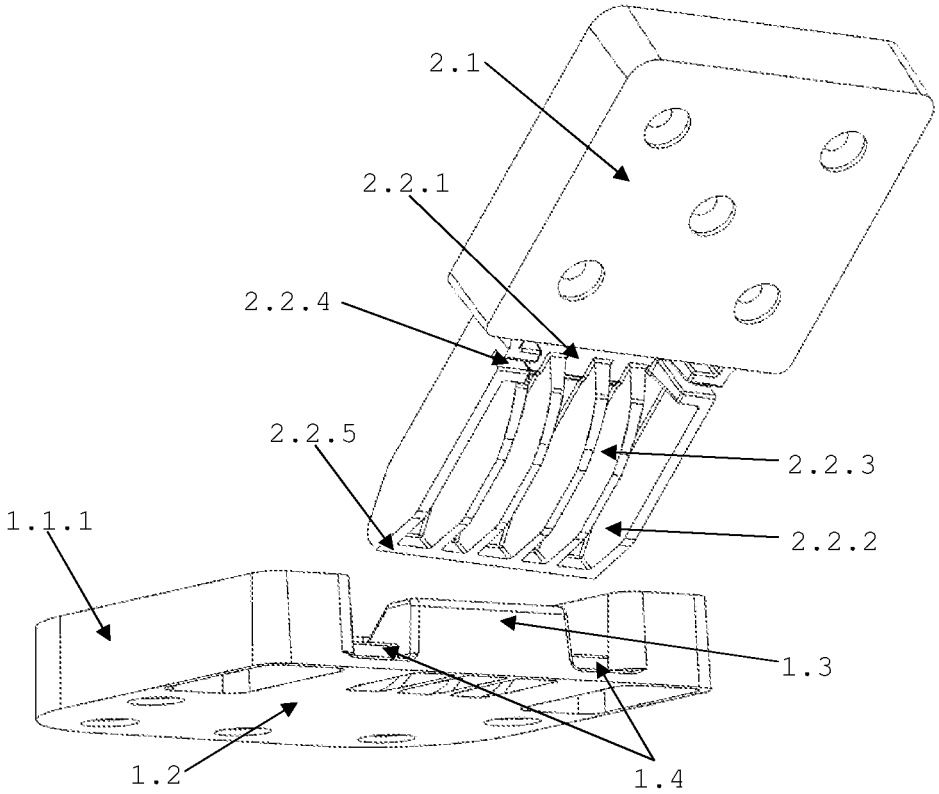
FIG. 13 shows an underneath view of the female element and the male element in the interlocked position.

For the system to be placed in the closed formation, the male element (2) is placed in a slanting position in relation to the female element (1), so that the female element (1) and the male element (2) are interconnectable, as can be seen in FIGS. 12 and 13. Then at least one slider (2.2.3), at least one ramp (1.3) and the rim (2.2.5) slides along the plate of the female (1.2) and/or at least one ramp (1.3), whereby the male element (2) and the female element (1) are aligned horizontally, the fitting element (2.2) fits into the cavity and at least one tongue (1.4) fits into at least one groove (2.2.4), when the system is in the closed formation, blocking the male element (2) from performing horizontal movements, perpendicular to longitudinal movements.

In the embodiment where there is more than one tongue (1.4) and there is more than one groove (2.2.4), each tongue (1.4) fits into the groove (2.2.4) that is complementary to it. In embodiments where there is one tongue (1.4) and one groove (2.2.4), the tongue (1.4) fits into the groove (2.2.4). In a preferred embodiment, the sloping side of at least one ramp (1.3) is in contact with the inner side of at least one slider (2.2.3). At least one ramp (1.3) is in contact with at least one overhang (2.1.2), specifically through the outer side. These contacts stop the longitudinal movements of the female element (1) and the male element (2).

The fitting element (2.2) is embedded in the cavity, more specifically between the sidewalls of the female (1.1.1). This implies that the plate of the male (2.2.1), the sidewalls of the male (2.2.2) and the rim (2.2.5) are in contact with the sidewalls of the female (1.1.1). Additionally, in a preferred embodiment, at least one ramp (1.3) is in contact with the groove walls (2.2.6). These contacts stop horizontal movements, perpendicular to longitudinal movements, of the female element (1) and the male element (2).

In a preferred embodiment, at least one ramp (1.3) is in contact with the plate of the male (2.2.1), more specifically, the top of at least one ramp (1.3) contacts the underside of the plate of the male (2.2.1). In a preferred embodiment, the sidewalls of the male (2.2.2) and at least one slider (2.2.3) contact the upper side of the plate of the female (1.2). These embodiments stop the male element (2) from making vertical movements, specifically downward movements.

Additionally, the plate of the male (2.2.1) is located underneath the floor module to which the female element (1) is attached. In a preferred embodiment, the entire outer portion and inner portion of the plate of the male (2.2.1) lie under the floor module to which the female element (1) is attached. This causes the plate of the male (2.2.1) and the sidewalls of the male (2.2.2) to come into contact with the floor module to which the female element (1) is attached, which prevents the male element (2) from making vertical movements, more specifically upward movements.

Fitting Method

In order for the fitting to take place, the female element (1) is attached to the floor module from the upper side of the body of the female (1.1). In a preferred embodiment, the female element (1) is attached to the floor module by means of fastening elements that pass through the openings of the female (1.1.3). In a second embodiment, the female element (1) is attached to the floor using an adhesive. The fitting is carried out such that the body of the female (1.1) and part of the plate of the female (1.2) are under the floor module, and the part of the plate of the female (1.2) that contains at least one ramp (1.3) and at least one tongue (1.4) is outside the floor module. In a preferred embodiment, the body of the female (1.1) is partially under the floor module. In a second embodiment, the body of the female (1.1) is completely under the floor module.

The male element (2) is attached to the floor module through the upper side of the body of the male (2.1). In a preferred embodiment, the male element (2) is attached by fastening elements that pass through the openings of the male (2.1.1). In a second embodiment, the male element (2) is attached using adhesives. The fitting is carried out such that the body of the male (2.1) is completely under the floor module and the fitting element (2.2) is partially under the same floor module.

The modules are fitted together using the following fitting method, whereby the female element (1) and the male element (2) are attached to different floor modules:

a) the male element (2) is placed in a slanting position in relation to the female element (1), and the rim (2.2.5) is directed toward the female element (1), more specifically to the cavity. The male element (2) is in a higher position than the female element (1). The underside of the body of the male (2.1) and the plate of the male (2.2.1) are oriented toward the plane on which the female element (1) is positioned;

b) the male element (2) moves toward the female element (1). This movement is performed until the rim (2.2.5) comes into contact with at least one ramp (1.3) or the plate of the female (1.2), more specifically the top or sloping side of at least one ramp (1.3) or the upper side of the plate of the female (1.2);

c) at least one slider (2.2.3), at least one ramp (1.3) and the rim (2.2.5) slide along at least one ramp (1.3) and/or the plate of the female (1.2). The sliding moves the male element (2) towards a substantially horizontal position relative to the female element (1), until:

at least one slider (2.2.3) is positioned on the plate of the female (1.2);

the plate of the male (2.2.1) is positioned on at least one ramp (1.3); and the body of the male (2.1) is partly underneath the floor module to which the female element (1) is attached;

d) at least one tongue (1.4) fits into at least one groove (2.2.4), leaving the system in the closed formation.

To disassemble the system, follow these steps:

a) lift the body of the male (2.1) in such a way that it comes out of at least one groove (2.2.4) and at least one tongue (1.4);

b) at least one slider (2.2.3), at least one ramp (1.3) and the rim (2.2.5) slides along the plate of the female (1.2) and at least one ramp (1.3), so that the position of the male element (2) gradually moves more and more towards a vertical position. The sliding between at least one slider (2.2.3) and at least one ramp (1.3) occurs, more specifically, between the inner side of at least one slider (2.2.3) and the sloping side of at least one ramp (1.3). Sliding occurs until at least one slider (2.2.3) is no longer in contact with at least one ramp (1.3);

c) the male element (2) moves until the fitting element (2.2) is no longer directly above the female element (1).

The invention claimed is:

1. A fitting system for floor modules comprising:

a female element comprising:

a U-shaped body of the female element;

a cavity present in a gap enclosed by the body of the female element; and at least one ramp included in the cavity;

a male element comprising:

a fitting element; and at least one slider comprised in the fitting element;

characterized in that:

the at least one ramp is arranged on a plate of the female element, positioned between sidewalls of the female;

the male element being interconnectable with the female element by placing the male element in a slanting position in relation to the female element, sliding the at least one slider along the at least one ramp;

the male element and the female element being aligned horizontally and the fitting element fitting into the cavity when the system is in a closed formation, blocking the male element from making horizontal movements, perpendicular to longitudinal movements.

2. The system according to claim 1, characterized in that the female element being attached to the floor module by fastening elements.

3. The system according to claim 1, characterized in that the at least one slider having a shape substantially complementary to the shape of the at least one ramp.

4. The system according to claim 1, characterized in that the fitting element additionally comprising a rim.

5. The system according to claim 4, characterized in that the male element being interconnectable with the female element by sliding the rim along the plate of the female element or the at least one ramp.

6. The system according to claim 4, characterized in that the male element being interconnectable with the female element by sliding the rim along the plate of the female element and along at the at least one ramp and the male element being attached to the floor module by fastening elements.

7. The system according to claim 1 characterized in that:

the female element additionally comprising at least one tongue;

the male element comprising at least one groove that is dimensioned so that the at least one tongue fits snugly into the at least one groove;

in the closed formation, the at least one tongue fitting into the at least one groove; and the at least one groove being delimited by groove walls and being incorporated into sidewalls of the male element.

8. The system according to claim 1 characterized in that the body of the female element and at the least one ramp being seated on the plate of the female element and the cavity being additionally delimited below by the plate of the female element.

9. The system according to claim 1 characterized in that the male element additionally comprising a body of the male element that comprises at least one overhang.

10. The system according to claim 1 characterized in that the fitting element additionally comprise a plate of the male element and sidewalls of the male element.

11. The system according to claim 1 characterized in that the fitting element having a width configured to fit snugly into the gap between the female element sidewalls of the female element and the fitting element being located under the floor module to which the female element is attached.

12. The system according to claim 1 characterized in that the body of the female element comprising openings of the female and the body of the male element comprising openings of the male element.

13. The system according to claim 10, characterized in that the fastening elements passing through the openings of the female element and through the openings of the male element.

14. A method of fitting the female element and the male element of the system as defined in claim 1 further comprising the following steps:

the male element is placed in a slanting position in relation to the female element, whereby the rim is directed towards the cavity of the female element, the male element is in a higher position than the female element and the underside of the body of the male element and of the plate of the male element face the plane on which the female element is seated;

the male element moves towards the female element, until the rim contacts the at least one ramp or the plate of the female element;

the at least one slider slides along the at least one ramp and the rim through the plate of the female element and through the at least one ramp or through the plate of the female element and through the at least one ramp, until:

the at least one slider lies on the plate of the female element, the plate of the male element lies on the at least one ramp, and the body of the male element is partly underneath the floor module to which the female element is attached; and at least one tongue fits into at least one groove.

15. A method of disengaging the female element and the male element of the system as defined in claim 1 further comprising the following steps:

the body of the male element is raised in such a way that at least one groove and at least one tongue become detached;

the at least one slider slides along the at least one ramp and a rim through the plate of the female element and the at least one ramp, so that the position of the male element gradually moves towards a vertical position, until the at least one slider is no longer in contact with the at least one ramp;

the male element moves until the fitting element is no longer directly above the female element.

* * * * *